US009115320B2

(12) United States Patent
Hu et al.

(10) Patent No.: US 9,115,320 B2
(45) Date of Patent: Aug. 25, 2015

(54) CONVEYING APPARATUS, SYSTEMS AND METHOD

(75) Inventors: Lishun Hu, Shanghai (CN); Wei Chen, Shanghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 313 days.

(21) Appl. No.: 13/493,964

(22) Filed: Jun. 11, 2012

(65) Prior Publication Data

US 2012/0321396 A1 Dec. 20, 2012

(30) Foreign Application Priority Data

Jun. 14, 2011 (CN) ..... 2011 1 0158617

(51) Int. Cl.
*B65G 51/18* (2006.01)
*C10J 3/50* (2006.01)

(52) U.S. Cl.
CPC ..... *C10J 3/506* (2013.01); *C10J 2200/15* (2013.01)

(58) Field of Classification Search
USPC ..... 406/92, 93, 144, 146, 195
See application file for complete search history.

(56) References Cited

U.S. PATENT DOCUMENTS

| | | | | |
|---|---|---|---|---|
| 368,691 | A * | 8/1887 | See | 114/184 |
| 2,326,438 | A * | 8/1943 | Clarke | 208/153 |
| 3,490,654 | A * | 1/1970 | Fischer | 406/123 |
| 4,155,682 | A * | 5/1979 | Hillis | 417/169 |
| 4,420,279 | A * | 12/1983 | Easley, Jr. | 406/14 |
| 4,451,184 | A * | 5/1984 | Mitchell | 406/105 |
| 4,993,887 | A * | 2/1991 | Schulze | 406/193 |
| 5,284,405 | A * | 2/1994 | Carpenter | 406/194 |
| 6,176,647 | B1 * | 1/2001 | Itoh | 406/31 |
| 7,311,476 | B2 * | 12/2007 | Gilbert et al. | 406/198 |
| 7,883,556 | B1 | 2/2011 | Wintrell | |
| 8,377,387 | B2 * | 2/2013 | Dinu et al. | 422/232 |

FOREIGN PATENT DOCUMENTS

| | | |
|---|---|---|
| GB | 2268976 A | 1/1994 |
| JP | 60030902 A2 | 2/1985 |

OTHER PUBLICATIONS

CN Office Action dated Aug. 1, 2013 from corresponding CN Application No. 201110158617.2, along with unofficial unofficial English Transaction.

Shoujian, "Discussion on the Design of Key Equipment for Shell Coal Gasification", Gas Purification, Technological Exchange, vol. No. 3, Issue No. 5, pp. 11-13, 2003.

Zhiyuan et al., "Shell coal gasification technology", Chemical Industry and Engineering Progress, pp. 998-1000, 2003.

(Continued)

*Primary Examiner* — Joseph Dillon, Jr.

(74) *Attorney, Agent, or Firm* — GE Global Patent Operation; Peter T. DiMauro

(57) ABSTRACT

A conveying apparatus is provided. The conveying apparatus comprises a conveying pipeline and a supplementary gas pipeline extending into the conveying pipeline. The conveying pipeline defines an inlet and an outlet, and comprises an expanding portion defining the inlet, a shrinking portion defining the outlet, and an intermediate portion disposed between and in fluid communication with the expanding portion and the shrinking portion. A conveying apparatus and a conveying method are also presented.

14 Claims, 2 Drawing Sheets

(56) References Cited

OTHER PUBLICATIONS

Zhaobin et al., "Technical Evaluation of the Shell Powdered Coal Pressure Gasification and the New Water-coal-slurry Pressure Gasification", Henan Chemical Engineering, 2nd Periodical, pp. 40-42, 2004.

Hongqing, "The evaluation of Shell coal gasification process and its ways of improvement", Coal Chemical Industry, Issue No. 6, pp. 9-14, Dec. 2005.

Xue-Feng, "Design for conveying piping of SCGP pulverized coal", Chemical Fertilizer Design, Dec. 2006.

Jia-Ming, "Technology of Shell gas and its application in our country", Guangzhou Chemical, pp. 19-22, 2006.

Yuelan et al., "Analysis and comparison of Texaco and Shell coal gasification process", Journal of Chemical Industry & Engineering, vol. No. 28, Issue No. 6, pp. 57-60, Dec. 2007.

* cited by examiner

CONVEYING APPARATUS, SYSTEMS AND METHOD

BACKGROUND OF THE INVENTION

1. Field of the Invention

Embodiments of the present invention relate to conveying apparatuses, systems and conveyance methodologies. More particularly, the embodiments of the invention relate to conveying apparatuses, systems and conveyance methodologies for pneumatic conveyance of solid powders such as carbonaceous fuel powders into gasifiers for gasification.

2. Description of the Related Art

Gasification is a process that enables the conversion of carbonaceous fuels, such as coal into a combustible gas, such as coal gas or synthesis gas. Generally, gasification processes include feeding carbonaceous fuels into gasifiers along with a controlled and/or limited amount of oxygen and other steams. A stable and controllable flow of such carbonaceous fuels into gasifiers is beneficial for obtaining desirable gasification performance.

Pneumatic conveyance technologies are often used to convey carbonaceous fuels into gasifiers. In conventional conveying systems employing pneumatic conveyance technologies, such conveying systems typically comprise storage tanks, feeding pipelines in fluid communication with the storage tanks, and a conveying pipeline disposed between and in fluid communication with the storage tanks and the gasifiers.

The storage tanks receive carbonaceous fuels and carrier gases through the feeding pipelines. With the introduction of the carrier gases into the storage tanks, the pressures of the storage tanks increase to desired levels, which are higher than pressures in the gasifiers so as to generate pressure differences between such storage tanks and gasifiers. A gas solid mixture then may be conveyed from the storage tanks into the gasifiers through the conveying pipeline in virtue of the pressure differences.

However, in such conventional conveying systems, the flow of the carbonaceous fuels within the conveying pipeline may have an unstable flow. For example, in a plug flow situation results in flow rates of the carbonaceous fuels within the conveying pipeline that is not uniform and thus become unstable for introduction of the carbonaceous fuels into the gasifiers. This may generate temperature fluctuations in the gasifiers, which is disadvantageous to the performance and service life of the gasifiers.

Therefore, there is a need for a new and improved conveying apparatuses, systems and methods for pneumatic conveyance of solid powders such as carbonaceous fuel powders.

BRIEF SUMMARY OF THE INVENTION

According to an embodiment of the invention a conveying apparatus for pneumatic conveyance of a solid powder is provided. The conveying apparatus comprises a conveying pipeline and a supplementary gas pipeline extending into the conveying pipeline. The conveying pipeline defines an inlet and an outlet, and comprises an expanding portion defining the inlet, a shrinking portion defining the outlet, and an intermediate portion disposed between and in fluid communication with the expanding portion and the shrinking portion.

According to an embodiment of the invention a conveying system for pneumatic conveyance of a solid powder is provided. The conveying system comprises a storage tank configured to receive a solid powder, a carrier gas pipeline in fluid communication with the storage tank, a conveying pipeline, and a supplementary gas pipeline in fluid communication with the conveying pipeline. The conveying pipeline is disposed downstream of and in fluid communication with the storage tank, and comprises an expanding portion defining an inlet, a shrinking portion defining an outlet, and an intermediate portion disposed between and in fluid communication with the expanding portion and the shrinking portion.

According to an embodiment of the invention a method for pneumatic conveyance of a solid powder is provided. The conveying method comprises feeding a solid powder into a storage tank, introducing a carrier gas into the storage tank to mix with the solid powder to form a gas solid mixture in the storage tank, conveying the gas solid mixture from the storage tank into a conveying apparatus through an inlet of the conveying apparatus for adjustment, and conveying the adjusted gas solid mixture out of the conveying apparatus through an outlet of the shrinking portion. The conveying apparatus comprises a conveying pipeline and a supplementary gas pipeline in fluid communication with the conveying pipeline. The conveying pipeline comprises an expanding portion defining the inlet, a shrinking portion defining the outlet, and an intermediate portion disposed between and in fluid communication with the expanding portion and the shrinking portion.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE INVENTION

Embodiments of the present disclosure will be described hereinbelow with reference to the accompanying drawings. In the following description, well-known functions or constructions are not described in detail to avoid obscuring the disclosure in unnecessary detail.

Figure 1:
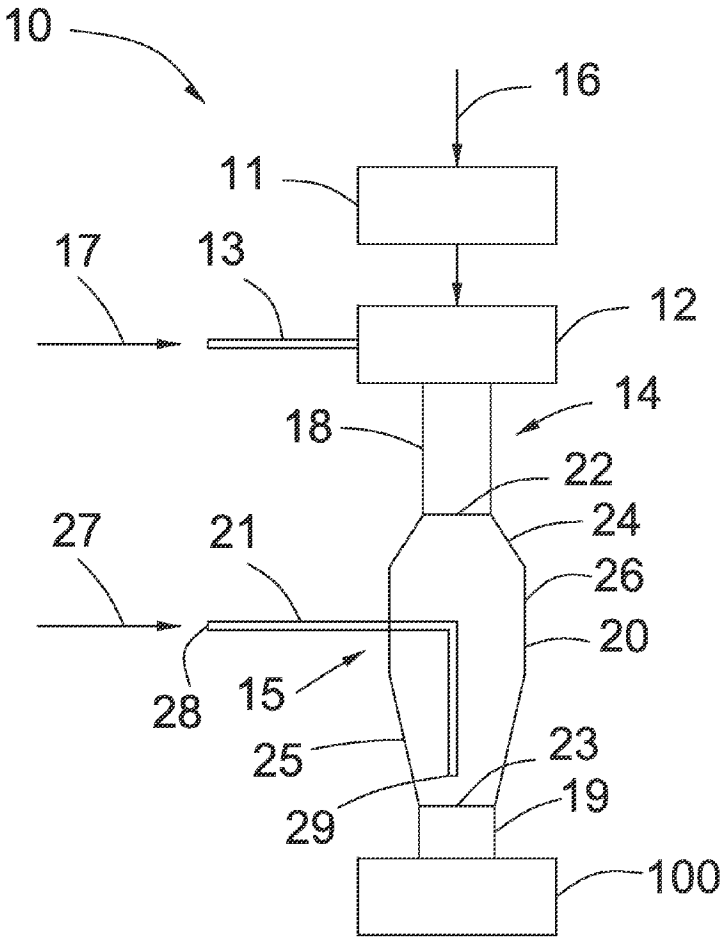
FIG. 1 is a schematic diagram of a conveying system in accordance with one embodiment of the invention.

FIG. 1 illustrates a schematic diagram of a conveying system 10 for conveying a solid powder, such as one or more carbonaceous fuels into a device 100 for processing in accordance with one embodiment of the invention. In non-limiting examples, the conveying system 10 is configured for pneumatic conveyance of the solid powder into the device 100, where the device 100 may be a gasifier for gasification of the solid carbonaceous fuels. In one example, the carbonaceous fuels include coal. In other non-limiting examples, the carbonaceous fuels may include bituminous, soot, biomass, petroleum coke or combinations thereof.

As illustrated in FIG. 1, the conveying system 10 comprises a feeder 11, a storage tank 12, a carrier gas pipeline 13, a feeding pipeline 14, and a conveying apparatus 15. In some examples, the feeder 11 is configured to feed a solid powder 16 with desired size distribution into the storage tank 12. In one non-limiting example, the feeder 11 may comprise a screw feeder.

The storage tank 12 is in fluid communication with the feeder 11 and configured to receive the solid powder 16 through a conveyance, such as a pipeline (not shown) by way of the feeder 11. In other examples, a pump (not shown) may be employed to introduce the solid powder 16 into the storage tank 12. For some arrangements, the storage tank 12 may not limit to any particular shapes. In non-limiting examples, the storage tank 12 may comprise an upper portion (not shown) disposed downstream of and in fluid communication with the feeder 11, and a lower portion (not shown) connected with the upper portion. In one example, the upper portion of the storage 12 may have a cylindrical shape and the lower portion of the storage 12 may have a conical shape.

The carrier gas pipeline 13 is disposed on the storage tank 12 and configured to introduce a carrier gas 17 into the storage tank 12 to mix with the solid powder 16 to form a gas solid mixture. Non-limiting examples of the carrier gas 17 include carbon dioxide, inert gas such as nitrogen or other suitable gases. Although one carrier gas pipeline 13 is shown in the illustrated embodiment, more than one carrier gas pipeline 13 may nonetheless be employed.

With the introduction of the carrier gas 17 into the storage tank 12, the pressures of the storage tank 12 may increase to desired levels. In non-limiting examples, the desired pressure in the storage tank 12 may be higher than a pressure in the device 100 so as to generate a pressure difference between the storage tank 12 and the device 100. In one example, the desired pressure in the storage tank 12 is about 3 Mega Pascals (Mpa).

The feeding pipeline 14 is disposed between and in fluid communication with the storage tank 12 and the device 100 respectively so as to convey the gas solid mixture from the storage tank 12 into the device 100 for processing, for example, for gasification. In non-limiting examples, the feeding pipeline 14 may have a cylindrical shape.

In the illustrated example, the feeding pipeline 14 comprises a first feeding pipeline 18 and a second feeding pipeline 19. The first feeding pipeline 18 is disposed between the storage tank 12 and the conveying apparatus 15, and is configured to convey the gas solid mixture from the storage tank 12 into the conveying apparatus 15. The second feeding pipeline 19 is disposed between the conveying apparatus 15 and the device 100, and is configured to convey the gas solid mixture from the conveying apparatus 15 into the device 100. In certain applications, the second feeding pipeline 19 may or may not be employed.

In some applications, the flow of the gas solid mixture may be in an unstable flow in the first conveying pipeline 18, for example, in a plug flow resulting in the flow rates of the solid powder in the first conveying pipeline 18 not being uniform. For the illustrated arrangement, the conveying apparatus 15 is disposed between and in fluid communication with the first and second conveying pipelines 18, 19, and is configured to stabilize the flow of the gas solid mixture. As a result, after adjustment by the conveying apparatus 15, the flow rates of the solid powder may be uniform and the gas solid mixture may be stably introduced into the second conveying pipeline 19 for stable introduction into the device 100.

As depicted in FIG. 1, the conveying apparatus 15 comprise a conveying pipeline 20 and a supplementary gas pipeline 21 coupled to the conveying pipeline 20. For the illustrated arrangement, the conveying pipeline 20 is disposed downstream of the storage tank 12, and defines an inlet 22 and an outlet 23 to be in fluid communication with the first and second feeding pipelines 18, 19 respectively for the gas solid mixture from the first feeding pipeline 18 passing through the conveying pipeline 20 for introduction into the device 100.

In the illustrated example, the conveying pipeline 20 comprises an expanding portion 24, a shrinking portion 25, and an intermediate portion 26 disposed between and connected to the expanding portion 24 and the shrinking portion 25. The expanding portion 24 defines the inlet 22 and the shrinking portion 25 defines the outlet 23.

In some examples, the expanding portion 24 and the shrinking portion 25 may have a shape of frustum of a cone. The intermediate portion 26 may have a cylindrical shape. Alternatively, the expanding portion 24, the shrinking portion 25, and the intermediate portion 26 may have other shapes, such as polygon shapes.

In non-limiting examples, as used herein, the term "expanding" means diameters of the expanding portion 24 may increase along a direction from the inlet 22 to the outlet 23 or a flow direction of the gas solid mixture in the conveying pipeline 20. The term "shrinking" means diameters of the shrinking portion 25 may decrease along the direction from the inlet 22 to the outlet 23. In some examples, the diameters of at least a section of the expanding portion 24 may be larger than diameters of the first feeding pipeline 18. The diameters of at least a section of the shrinking portion 25 may be larger than diameters of the second feeding pipeline 19. In one non-limiting example, diameters of the intermediate portion 26 may be larger than the diameters of at least a section of at least one of the expanding portion 24 and shrinking portion 25. The diameters of the first feeding pipeline 18 are similar to the diameters of the second feeding pipeline 19.

In some applications, the supplementary gas pipeline 21 is configured to introduce a supplementary gas 27 into the conveying pipeline 20 through an inlet 28 thereof for facilitating conveyance of the solid powder. In the illustrated example, the supplementary gas pipeline 21 is disposed on the intermediate portion 26 and extends into the conveying pipeline 20 so that an outlet 29 thereof extends or is exposed into a space defined by the shrinking portion 25. In one example, at least a portion of the supplementary gas pipeline 21 extends towards the outlet 23 of the conveying pipeline 20 so that the outlet 29 is near the outlet 23. In other examples, the supplementary gas pipeline 21 may be disposed on the expanding portion 24 or the shrinking portion 25 and extend towards the outlet 23.

Thus, during introduction of the gas solid mixture from the first feeding pipeline 18 into the conveying pipeline 20 through the inlet 22, in the expanding portion 24, a velocity of the gas in the gas solid mixture from the feeding pipeline 18 may be reduced and a velocity of the solid in the gas solid mixture may be similar to a velocity of the gas solid mixture in the feeding pipeline 18, so that at least a portion of the gas is separated from at least a portion of the solid in the gas solid mixture due to space expanding of the expanding portion 24. Accordingly, the flow pattern, for example an unstable flow pattern of the gas solid mixture in the feeding pipeline 18 may be changed or adjusted by the expanding portion 24.

In some embodiments, the intermediate portion 26 may act as a buffer portion so that the gas continues to be separated from solid powder so as to further change the flow pattern of the gas solid mixture. In the shrinking portion 25, due to space limitation thereof, a velocity of the separated gas may increase towards the outlet 23 and remix with the solid powder for carrying the solid powder. In addition, the supplementary gas pipeline 21 also introduces the supplementary gas 27 into the shrinking portion 25 through the outlet 29 to further increase the velocity of the gas for remixing with the solid powder. As a result, with the adjustment by the conveying apparatus 15, the gas and the solid powder may be mixed uniformly to form a gas solid mixture having a stable flow pattern.

Thus, the gas solid mixture from the conveying apparatus 15 may be introduced into the second feeding pipeline 19 uniformly and stably through the outlet 23 for introduction into the device 100. Compared to the previous flow pattern, for example, the plug flow of the gas solid mixture in the first feeding pipeline 18, due to adjustment by the conveying apparatus 15, the flow rates of the solid powder may become uniform and stable. Thus, the flow of the gas solid mixture from the conveying apparatus 15 may also become uniform and stable. In some applications, similar to the carrier gas 17, non-limiting examples of the supplementary gas 27 also include carbon dioxide, inert gas such as nitrogen or other suitable gases.

It should be noted that the arrangement in FIG. 1 is merely illustrative. In the illustrated example, one supplementary gas pipeline 21 is employed. Alternatively, more than one supplementary gas pipeline may be employed. In certain applications, an additional gas pipeline (not shown) may be disposed on the first feeding pipeline 18 for introducing a gas to adjust the concentration of the solid powder in the first feeding pipeline 18. Although integrated together to act as a single element in the illustrated example, the expanding portion 24, the shrinking portion 25 and the intermediate portion 26 may be provided separately and assembled together.

In certain applications, the carrier gas 17 and the supplementary gas 27 may be provided from one gas source or from more than one gas sources. In addition, for the illustrated arrangement, the feeding pipeline 14 and/or the conveying pipeline 20 are disposed above the device 100 and upright relative to a horizontal direction (not shown). In other applications, longitudinal axis of the feeding pipeline 14 and/or the conveying pipeline 20 may have an angle in a range of from about 70° to about 90° relative to the horizontal direction.

Figure 2:
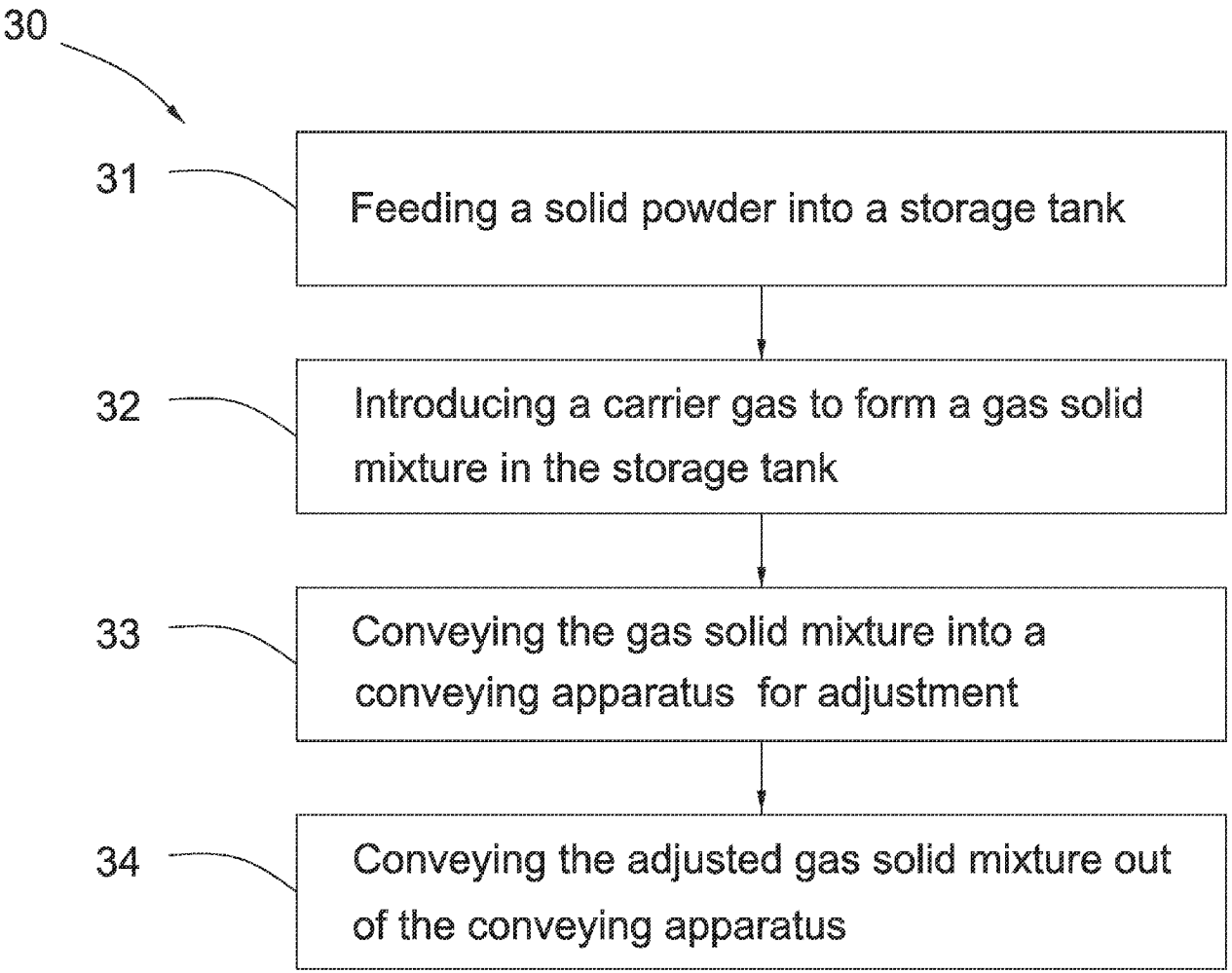
FIG. 2 is a schematic flow chart of operation of the conveying system in accordance with an embodiment of the invention.

FIG. 2 illustrates a schematic flow chart 30 of operation of the conveying system 10 in accordance with one embodiment of the invention. As illustrated in FIG. 2, during conveyance, in step 31, a solid powder 16 having desired size distribution is introduced into the storage tank 12 from a solid powder source (not shown). In step 32, a carrier gas 17 is introduced into the storage tank 12 through the carrier gas pipeline 13 to form the gas solid mixture and increase the pressure in the storage tank 12. For some arrangements, the sequence for performing the steps 31 and 32 may vary. The step 31 may be performed prior to, simultaneous with or after the step 32.

With the introduction of the carrier gas 17 into the storage tank 12, the pressure in the storage tank 12 increases to a desired pressure. In one example, the desired pressure is higher than the pressure in the device 100 so that a pressure difference is produced to push the gas solid mixture from the storage tank 12 towards the device 100 and to offset the pressure drop during the conveyance of the gas solid mixture from the storage tank 12 to the device 100.

In step 33, after the pressure in the storage tank 12 increases to a desired pressure, the gas solid mixture is introduced into the conveying apparatus 15 for adjustment through the first feeding pipeline 18 connected the conveying apparatus 15 and the storage tank 12. In this step, the gas solid mixture from the first feeding pipeline 18 passes through the expanding portion 24, the intermediate portion 26 and the shrinking portion 25 of the conveying pipeline 20 in turn. Meanwhile, the supplementary gas 27 is introduced into the shrinking portion 25 for facilitating conveyance of the solid powder.

In some applications, the velocity of the supplementary gas 27 for introduction into the shrinking portion 25 may be higher than the velocity of the carrier gas 17 in the conveying pipeline 20. In non-limiting examples, the ratio of a flux of the supplementary gas 27 in the supplementary gas pipeline 21 to a flux of the carrier gas 17 in the first feeding pipeline 18 may be in a range of about 0.2 to about 1. The velocity of the gas in the second feeding pipeline 19 may be about in a range of from about 20 m/s to about 40 m/s.

As a result, due to adjustment of the conveying apparatus 15 to the gas solid mixture from the first feeding pipeline 18, the flow rates of the solid powder become uniform and the gas and the solid may be mixed uniformly resulting in the flow of the adjusted gas solid mixture from the conveying apparatus 15 become stable. In step 34, the adjusted gas solid mixture from the conveying apparatus 15 is introduced into the gasifier 100 for gasification.

In embodiments of the invention, the conveying system 10 employs the conveying apparatus 15 to stabilize the gas solid mixture from the feeding pipeline 14. The conveying apparatus 15 employs a supplementary gas pipeline 21 and a conveying pipeline 30 including the expanding portion 24, the intermediate portion 26 and the shrinking portion 25 to adjust the flow of the gas solid mixture, so that the flow rates of the solid powder become uniform and stable, and the flow of the gas solid mixture from the conveying apparatus 15 also become uniform and stable for conveyance into the device 100. This improves the performance and life time of the device 100, for example, the gasifier. Compared to the conventional conveying systems, the arrangements of the invention may have a relatively simple configuration and may be used to retrofit the conventional conveying system in a lower cost.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A conveying apparatus for pneumatic conveyance of a solid powder, comprising:

a conveying pipeline defining an inlet and an outlet, wherein the conveying pipeline comprises,
an expanding portion defining the inlet;
a shrinking portion defining the outlet; and
an intermediate portion disposed between and in fluid communication with the expanding portion and the shrinking portion,
wherein diameters of at least a section of the intermediate portion is larger than diameters of at least a section of each of the expanding portion and the shrinking portion; and a supplementary gas pipeline extending into the conveying pipeline, wherein the supplementary gas pipeline is disposed on the intermediate portion, and wherein the supplementary gas pipeline comprises an outlet disposed within the shrinking portion.

2. The conveying apparatus of claim 1, wherein diameters of the expanding portion increase along a direction from the inlet to the outlet, and where diameters of the shrinking portion decrease along the direction from the inlet to the outlet.

3. The conveying apparatus of claim 1, wherein a longitudinal axis of the conveying pipeline has an angle in a range of from about 70° to about 90° relative to a horizontal direction.

4. The conveying apparatus of claim 1, wherein the expanding portion, the shrinking portion and the intermediate portion are integral with each other.

5. A conveying system for pneumatic conveyance of a solid powder, comprising:

a storage tank configured to receive a solid powder;

a carrier gas pipeline in fluid communication with the storage tank;

a conveying pipeline disposed downstream of and in fluid communication with the storage tank, wherein the conveying pipeline comprises, an expanding portion defining an inlet;

a shrinking portion defining an outlet; and an intermediate portion disposed between and in fluid communication with the expanding portion and the shrinking portion; and a supplementary gas pipeline in fluid communication with the conveying pipeline.

6. The conveying system of claim 5, wherein diameters of the expanding portion increase along a direction from the inlet to the outlet, and where diameters of the shrinking portion decrease along the direction from the inlet to the outlet.

7. The conveying system of claim 5, wherein the supplementary gas pipeline is disposed on the intermediate portion, and wherein at least a portion of the supplementary gas pipeline is disposed within the conveying apparatus and extends towards the outlet of the conveying pipeline.

8. The conveying system of claim 5, wherein the supplementary gas pipeline extends into the conveying pipeline and defines an outlet disposed within the shrinking portion.

9. The conveying system of claim 5, further comprising a first feeding pipeline disposed between and in fluid communication with the storage tank and the conveying pipeline through the inlet of the expanding portion.

10. The conveying system of claim 9, further comprising a second feeding pipeline disposed downstream of and in fluid communication with the conveying pipeline through the outlet of the shrinking portion.

11. The conveying system of claim 10, wherein diameters of at least a section of the expanding portion are larger than diameters of the first feeding pipeline, and wherein diameters of at least a section of the shrinking portion are larger than diameters of the second feeding pipeline.

12. The conveying system of claim 10, wherein the first and second feeding pipelines and the conveying pipeline are disposed upright relative to a horizontal direction.

13. A conveying system for pneumatic conveyance of a solid powder as a gas-solid mixture, the apparatus comprising:

a storage tank configured to receive a solid powder;

a carrier gas pipeline disposed on the storage tank and configured to introduce a carrier gas into the storage tank to mix with the solid powder to form a gas solid mixture;

a conveying pipeline disposed downstream of and in fluid communication with the storage tank, wherein the conveying pipeline comprises, an expanding portion defining an inlet;

a shrinking portion defining an outlet; and an intermediate portion disposed between and in fluid communication with the expanding portion and the shrinking portion, wherein the conveying pipeline is disposed upright relative to a horizontal direction; and a supplementary gas pipeline in fluid communication with the conveying pipeline;

wherein the conveying pipeline is configured so that the gas-solid mixture passes through the expanding portion, the intermediate portion, and the shrinking portion in turn.

14. The conveying system of claim 13, further comprising a first feeding pipeline disposed between and in fluid communication with the storage tank and the conveying pipeline through the inlet of the expanding portion, and further comprising a second feeding pipeline disposed downstream of and in fluid communication with the conveying pipeline through the outlet of the shrinking portion.

* * * * *